United States Patent [19]

Phillips

[11] 4,235,574

[45] Nov. 25, 1980

[54] SPINNERET ORIFICE CROSS-SECTION

[75] Inventor: Bobby M. Phillips, Kingsport, Tenn.

[73] Assignee: Eastman Kodak Company, Rochester, N.Y.

[21] Appl. No.: 4,242

[22] Filed: Jan. 17, 1979

Related U.S. Application Data

[63] Continuation of Ser. No. 818,692, Jul. 25, 1977, abandoned.

[51] Int. Cl.[3] ..... B29C 25/00

[52] U.S. Cl. ..... 425/72 S; 264/177 F; 425/378 S; 425/464

[58] Field of Search ..... 264/177 F; 425/461, 425/72 S, 464

[56] References Cited

U.S. PATENT DOCUMENTS

| | | | |
|---|---|---|---|
| 2,000,388 | 5/1935 | Hofstadt | 425/461 |
| 2,464,746 | 3/1949 | Gering | 264/177 F |
| 3,103,264 | 9/1963 | Katan | 264/177 F |
| 3,346,916 | 10/1967 | Elbert et al. | 425/464 |
| 3,936,518 | 2/1976 | Soda et al. | 264/177 F |
| 4,068,517 | 1/1978 | Fuchs | 425/461 |
| 4,083,914 | 4/1978 | Schippers | 264/177 F |
| 4,101,620 | 7/1978 | Kops et al. | 264/177 F |

FOREIGN PATENT DOCUMENTS

| | | | |
|---|---|---|---|
| 44-899 | 1/1969 | Japan | 264/177 F |
| 50-118012 | 9/1975 | Japan | 264/177 F |

*Primary Examiner*—Jay H. Woo

*Attorney, Agent, or Firm*—Malcolm G. Dunn; Daniel B. Reece, III

[57] ABSTRACT

A novel spinneret orifice defines in the plane of a spinneret face an elongated slot formed by a series of repeating parallelograms connected in end-to-end relation together and alternating in off-set relation along the major axis of the elongated slot, each parallelogram having a pair of opposite side walls "a" substantially parallel to the minor axis of the elongated slot and a pair of opposite side walls "b" substantially parallel to the major axis, and wherein a side wall "a" of one parallelogram and the side wall "a" of the adjacent off-set parallelogram lie on a common line and define the angle of the minor axis relative to the major axis of the elongated slot.

5 Claims, 3 Drawing Figures

SPINNERET ORIFICE CROSS-SECTION

BACKGROUND OF THE INVENTION

The present invention is directed to spinnerets for spinning textile and industrial synthetic fibers, and is particularly directed to a spinneret orifice having a novel cross-section in the plane of a spinneret face.

Traditional round cross-section polyester staple fibers, while offering many processing advantages, do not provide adequate cover and aesthetics for many textile applications.

An object of the present invention, therefore, is to provide in the plane of a spinneret face a spinneret orifice of novel cross-section through which a fiber having improved cover, acceptable glitter, and improved aesthetics (soft and cotton-like) may be spun, such as a polyester staple fiber.

The spinneret orifice cross-section, disclosed by this invention and from which the fiber is melt extruded, is believed to be novel and different from any known prior art. The closest disclosure of a spinneret orifice formed of off-set parallelograms was found in FIG. 13 of the United Kingdom Pat. No. 1,102,051 (complete specification published Feb. 7, 1968); also see corresponding French Pat. No. 1,422,478 granted Nov. 15, 1965. Both patents were based on a U.S. patent application Ser. No. 337,661, filed Jan. 14, 1964, in the name of Gilbert Shaw (apparently no U.S. patent ever issued). The Shaw United Kingdom patent discloses a band or web of interconnected continuous filaments which become separated into individual filaments when a separating force is applied. In FIG. 13, the spinneret orifice appears to comprise three off-set parallelograms. Each parallelogram, however, is connected by a very thin slot so that the band of material extruded from one of the parallelograms may be readily separated from its adjacent neighbor. The side wall, therefore, of one parallelogram is not in alignment with or in the same plane as the side wall of the adjacent parallelogram, as is the case in the present invention. The fiber cross-section shown in FIG. 14 represents the fiber that has been extruded from the spinneret orifice shown in FIG. 13. The resulting fiber cross-section is entirely different from that disclosed in this invention.

SUMMARY OF THE INVENTION

The invention is directed to a spinneret orifice for a spinneret from which textile and industrial fibers may be spun, such as polyester fibers, the spinneret orifice having a novel cross-section in the plane of a spinneret face. The spinneret orifice has an elongated slot defining a series of off-set repeating parallelograms connected together. Each parallelogram has a pair of opposite side walls "a" that are substantially parallel to the minor axis of the slot and a pair of opposite side walls "b" substantially parallel to the major axis of the slot. The side wall "a" of one parallelogram and the side wall "a" of the adjacent off-set parallelogram lie on a common line. In other words, a straight line will co-linearly extend along one side wall of the first parallelogram and also along the side wall of the adjacent parallelogram.

The width of the slot between and connecting adjacent parallelograms has a normalized dimension of one (1) unit. The normalized dimension of one (1) unit typically ranges from about 75 to 150 microns. Side wall "a" has a normalized dimension that may range from two (2) to four (4) units. Side wall "b" has a normalized dimension that may range from one and one-half (1½) to six (6) units.

The number of repeating parallelograms in the series may range from three (3) to six (6).

The plane of each parallelogram has one set of included, opposed angles that may be designated $\alpha$(alpha), which may range from 90° to 135°; and has one set of included, opposed angles, each of which would be $180° - \alpha$(alpha).

Spinning conditions may vary in different ways, such as spinning rates, temperatures, the kinds of materials being extruded, processing conditions, and the like.

A fiber melt extruded from a polyester polymer, such as poly(ethylene terephthalate), will, upon solidification, have a different cross-section than one extruded from a cellulose acetate dope. Fibers extruded from polymers of different components may have still differently appearing cross-sections from the resulting cross-section of only one of the polymer components. Such factors are well known in the fiber industry.

Therefore, the one illustrated polyester fiber cross-section disclosed appears to have an undulating cross-section, and thus represents only one fiber cross-section that may be obtained by one embodiment of the herein-disclosed spinneret orifice at a predetermined spinning rate, temperature, material, etc.

DESCRIPTION OF THE PREFERRED EMBODIMENT

Figure 1:
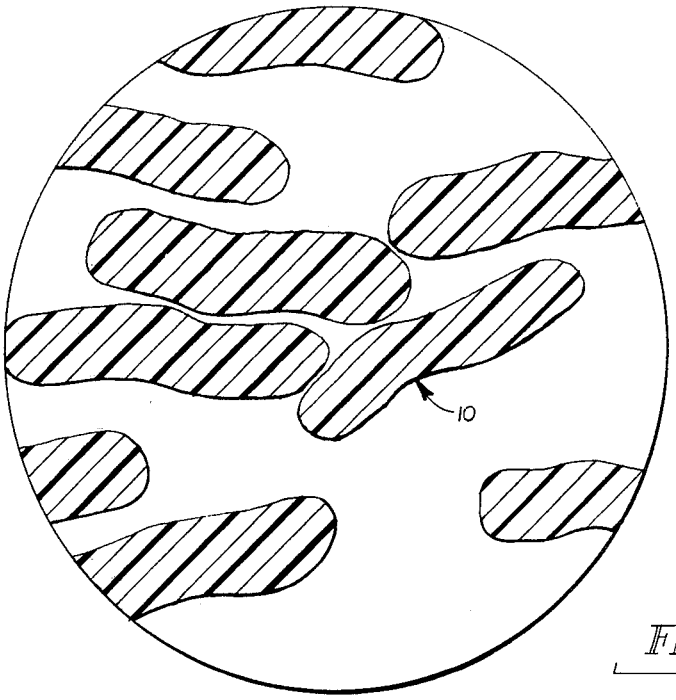
FIG. 1 is a view of an undulating cross-section of some polyester fibers that may be spun from one embodiment of the spinneret orifice of the invention, the fiber cross-sections being enlarged by magnification by about one thousand times.

In FIG. 1, some representative polyester fiber cross-sections 10 are shown, as taken from a photograph wherein the fiber cross-sections have been enlarged by magnification of about one thousand. The undulating cross-section of the polyester fiber, such as from polyethylene terephthalate polymer, was obtained by melt extrusion through a spinneret orifice similar to that shown generally in FIG. 2 at 12, the spinneret orifice being formed in the face of spinneret 13. Only a portion of spinneret 13 is illustrated since its configuration may take any suitable form such as round, obround, rectangular, etc.

Figure 2:
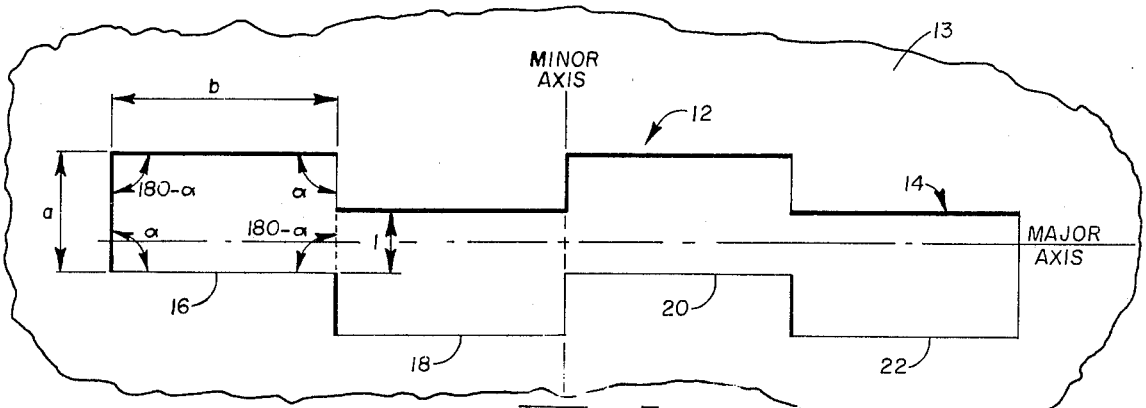
FIG. 2 is a plan view of a portion of a spinneret, partly broken away and illustrating a spinneret orifice in the form of an elongated slot characterized by a series of connected off-set parallelograms.

In FIG. 2, spinneret 13 has at least one spinneret orifice 12, which is in the shape of an elongated slot 14 formed from a series of connected parallelograms 16, 18, 20, 22, each being offset from its adjacent neighbor. The offset should be such that the width of the slot between and connecting adjacent parallelograms has a normalized dimension of one (1) unit. Side wall "a", as shown by designation in the drawing, then, should have a normalized dimension ranging from two (2) to four (4) units; and side wall "b", as also shown by designation in the drawing, then, should have a normalized dimension ranging from one and one-half ($1\frac{1}{2}$) to six (6) units, with respect to the normalized width of the slot.

Each parallelogram has two sets of included, opposed angles. One set may be defined so that each one of the set has an angle designation of $\alpha$(alpha). In the other or second set of included, opposed angles, each one has an angle designation of $180° - \alpha$(alpha).$\alpha$(alpha) may range from 90° to 135°.

Side wall "a" of each parallelogram is substantially parallel to the minor axis of the elongated slot 14, and side wall "b" is substantially parallel to the major axis of the elongated slot.

The number of repeated, off-set parallelograms in series, as previously indicated, may range from three (3) to six (6).

Figure 3:
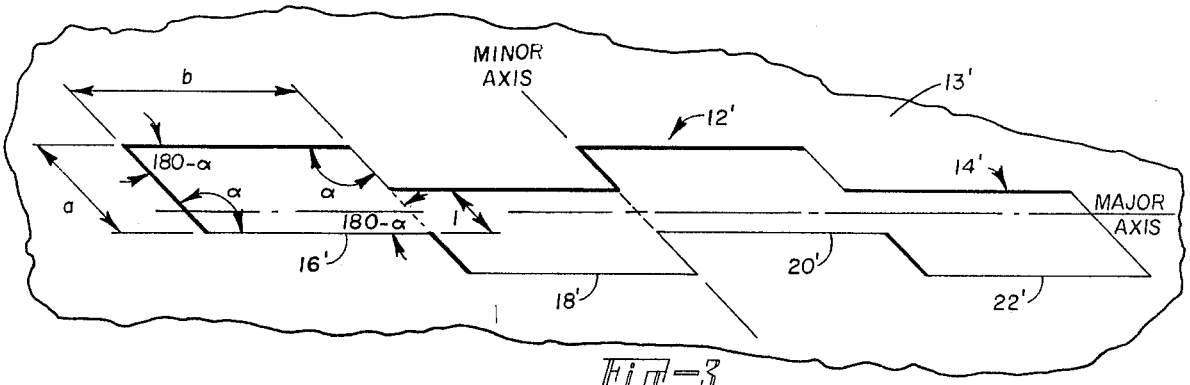
FIG. 3 is a plan view similar to that of FIG. 2 except for showing one of the alternate embodiments that the spinneret orifice may take.

FIG. 3 is another embodiment of spinneret 13' having at least one spinneret orifice 12', with all other reference numbers relating to corresponding elements in FIG. 2 being identified by the same reference numbers, but having prime marks thereafter.

The following are considered to be preferred embodiments of the parallelogram that the spinneret orifice may have:

| | |
|---|---|
| (1) | "a" = 2 |
| | "b" = 4 |
| | $\alpha$ = 90° |
| (2) | "a" = 4 |
| | "b" = 2 |
| | $\alpha$ = 90° |
| (3) | "a" = 3 |
| | "b" = 3 |
| | $\alpha$ = 90° |
| (4) | "a" = 4 |
| | "b" = 2 |
| | $\alpha$ = 135° |

An undrawn polyethylene terephthalate yarn was spun from a spinneret having orifices of the shape shown in FIG. 2. The yarn was drafted 3:1 and was heatset at constant length on a plate heater at 140° C. The physical properties of the resulting fibers were as follows:

| | |
|---|---|
| Denier/Filament | = 4 |
| Tenacity | = 3.8 grams/denier |
| Elongation | = 25% |
| Modulus | = 76 grams/denier |
| Boiling Water Shrinkage | = 6% |

These fibers were cut into $1\frac{1}{2}$ inch staple and spun into a 20/1 cotton count yarn. These yarns were woven into a plain weave fabric with a yarn made from 4 denier/-filament round cross-section fiber as a control. The fabric comparison showed improved cover and more cotton-like aesthetics for the experimental sample as compared to the round cross-section shape.

The yarn as made from the fibers of this invention may be useful for the manufacture of many textile goods, particularly in apparel.

The invention has been described in detail with particular reference to preferred embodiments thereof, but it will be understood that variations and modifications can be effected within the spirit and scope of the invention.

I claim:

1. A spinneret having formed within and extending through the plane of its face at least one spinneret orifice through which a fiber having an undulating cross-section may be spun, said spinneret orifice defining in said spinneret face plane an elongated slot formed by a series of repeating parallelograms connected in end-to-end relation together and alternating in offset relation along the major axis of said elongated slot, each parallelogram having a pair of opposite side walls "a" substantially parallel to the minor axis of said elongated slot and a pair of opposite side walls "b" substantially parallel to said major axis of said elongated slot, and wherein a side wall "a" of one parallelogram and the side wall "a" of the adjacent off-set parallelogram lie on a common line and define the angle of the minor axis relative to the major axis of said elongated slot.

2. A spinneret as defined in claim 1 and wherein the width of the elongated slot in said spinneret orfice between and connecting adjacent parallelograms has a normalized dimension of one (1) unit, side wall "a" has a normalized dimension ranging from two (2) to four (4) units and side wall "b" has a normalized dimension ranging from one and one-half ($1\frac{1}{2}$) to six (6) units.

3. A spinneret as defined in claim 1, wherein the number in said spinneret orifice of repeating parallelograms ranges from three (3) to six (6) in the series.

4. A spinneret as defined in claim 1, wherein in said spinneret face plane each parallelogram has one set of included, opposed angles $\alpha$ and one set of included, opposed angles $180° - \alpha$.

5. A spinneret as defined in claim 4, wherein said angle $\alpha$ ranges from 90° to 135°.

* * * * *